US010947801B2

(12) United States Patent
Schultz et al.

(10) Patent No.: US 10,947,801 B2
(45) **Date of Patent: *Mar. 16, 2021**

(54) DOWNHOLE VIBRATION ENHANDING APPARATUS AND METHOD OF USING AND TUNING THE SAME

(71) Applicant: Thru Tubing Solutions, Inc., Oklahoma City, OK (US)

(72) Inventors: Roger Schultz, Newcastle, OK (US); Andy Ferguson, Moore, OK (US)

(73) Assignee: Thru Tubing Solutions, Inc., Oklahoma city, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/588,372

(22) Filed: May 5, 2017

(65) Prior Publication Data

US 2017/0241223 A1 Aug. 24, 2017

Related U.S. Application Data

(63) Continuation of application No. 14/899,006, filed on Dec. 16, 2015.

(51) Int. Cl.

| | |
|---|---|
| ***E21B 28/00*** | (2006.01) |
| ***E21B 17/00*** | (2006.01) |
| ***E21B 7/24*** | (2006.01) |

(52) U.S. Cl.

CPC ..... *E21B 28/00* (2013.01); *E21B 7/24* (2013.01); *E21B 17/00* (2013.01); *E21B 17/006* (2013.01)

(58) Field of Classification Search

CPC ..... E21B 7/24; E21B 28/00; E21B 31/005

See application file for complete search history.

(56) References Cited

U.S. PATENT DOCUMENTS

| | | | | |
|---|---|---|---|---|
| 2,554,005 A * | 5/1951 | Bodine, Jr. | ..... | E21B 7/24 173/49 |
| 2,717,763 A * | 9/1955 | Bodine, Jr. | ..... | E21B 4/06 116/137 A |
| 2,858,108 A * | 10/1958 | Wise | ..... | E21B 7/24 175/103 |
| 2,893,692 A | 7/1959 | Marx | | |
| 2,903,242 A * | 9/1959 | Bodine, Jr. | ..... | E21B 7/24 173/49 |
| 2,948,059 A | 8/1960 | Bodine | | |
| 2,958,228 A | 11/1960 | Carrier, Jr. | | |
| 2,970,660 A * | 2/1961 | Bodine, Jr. | ..... | E21B 7/24 173/49 |
| 2,989,130 A | 6/1961 | Mathewson, Jr. | | |

(Continued)

OTHER PUBLICATIONS

International Search Report and Written Opinion; PCT/US2015/024759; dated Jul. 15, 2015; 17 pages.

*Primary Examiner* — Aaron L Lembo

(74) *Attorney, Agent, or Firm* — Hall Estill Law Firm

(57) ABSTRACT

The present disclosure is directed to an apparatus for use with a vibratory tool in a bottom hole assembly to enhance the vibration of the bottom hole assembly. The apparatus includes at least one spring mechanism and a fluid passageway disposed within a housing. The apparatus can be tuned and/or parts of the bottom hole assembly can be manipulated to match the frequency of the vibratory tool and/or the frequency of the vibratory tool can be tuned to match the vibrational frequency of the bottom hole assembly and the apparatus.

28 Claims, 5 Drawing Sheets

(56) References Cited

U.S. PATENT DOCUMENTS 3,139,146 A * 6/1964 Bodine, Jr. ..... E21B 7/24 175/107
3,315,755 A * 4/1967 Brooks ..... E21B 7/24 175/56
3,360,056 A * 12/1967 Bodine, Jr. ..... E21B 7/208 166/72
3,431,988 A * 3/1969 Bodine, Jr. ..... B06B 1/10 175/19
3,597,929 A * 8/1971 Bodine ..... E21B 7/24 173/52
3,610,347 A 10/1971 Diamantides
3,684,037 A * 8/1972 Bodine ..... E21B 7/24 173/162.1
3,686,877 A * 8/1972 Bodin ..... E02D 7/18 173/49
3,815,691 A * 6/1974 Richter, Jr. ..... E21B 7/24 175/320
3,848,672 A * 11/1974 Bodine ..... E21B 7/20 166/249
4,023,628 A * 5/1977 Bodine ..... E21B 7/24 175/106
4,236,580 A * 12/1980 Bodine ..... E21B 31/005 166/177.1
4,271,915 A * 6/1981 Bodine ..... E21B 7/24 175/105
4,299,279 A * 11/1981 Bodine ..... E21B 31/005 166/177.1
4,407,365 A 10/1983 Cooke, Jr.
4,553,443 A * 11/1985 Rossfelder ..... B06B 1/161 173/147
4,603,748 A * 8/1986 Rossfelder ..... B06B 1/161 173/49
4,658,897 A 4/1987 Kompanek
5,027,908 A * 7/1991 Roussy ..... E02D 7/26 172/40
5,090,485 A * 2/1992 Pomonik ..... E21B 7/24 173/1
5,234,056 A 8/1993 Bodine
6,332,841 B1 12/2001 Secord
7,264,055 B2 9/2007 Mody et al.
7,357,197 B2 4/2008 Schultz
7,591,327 B2 9/2009 Hall et al.
8,365,818 B2 * 2/2013 Schultz ..... E21B 31/1135 166/178
8,907,268 B2 12/2014 Saenger
9,057,258 B2 * 6/2015 Benson ..... E21B 7/06
9,109,410 B2 * 8/2015 Swietlik ..... E21B 17/073
9,316,100 B2 * 4/2016 Benson ..... E21B 47/00
9,470,055 B2 10/2016 Harrigan
9,890,601 B2 * 2/2018 Baudoin ..... E21B 21/103
2002/0092651 A1 7/2002 Bernat
2002/0121378 A1 * 9/2002 Zheng ..... E21B 4/18 166/381
2002/0148606 A1 10/2002 Zheng
2003/0217850 A1 11/2003 Shaw et al.
2010/0194117 A1 8/2010 Pabon
2011/0198126 A1 * 8/2011 Swietlik ..... E21B 17/07 175/55
2012/0012751 A1 1/2012 Saenger
2012/0048619 A1 3/2012 Seutter et al.
2012/0048621 A1 * 3/2012 Stewart ..... E21B 7/04 175/56
2012/0247832 A1 10/2012 Cramer
2014/0083772 A1 3/2014 Wiercigroch
2015/0075276 A1 3/2015 Cooper
2015/0159452 A1 * 6/2015 Miller ..... E21B 28/00 166/384
2016/0273294 A1 9/2016 Moyes
2017/0030158 A1 2/2017 Harrigan

* cited by examiner

DOWNHOLE VIBRATION ENHANDING APPARATUS AND METHOD OF USING AND TUNING THE SAME

CROSS-REFERENCE TO RELATED APPLICATIONS

The present application is a continuation of U.S. Ser. No. 14/899,006, filed Dec. 16, 2015, which is a U.S. National Stage filing of International Application No. PCT/US2015/024759, filed Apr. 20, 2015, which claims priority to U.S. Provisional Application having U.S. Ser. No. 61/976,241, filed Apr. 7, 2014, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

SUMMARY OF THE DISCLOSURE

The present disclosure is directed toward a vibration enhancing apparatus that includes a first end and a second end. The apparatus also includes a passageway disposed at least partially within a housing to permit fluid to flow through the apparatus. Furthermore, the apparatus includes at least one spring designed having a spring constant that is responsive to a vibratory tool and other tools used in a bottom hole assembly with the apparatus.

The present disclosure is also directed toward a vibration enhancing apparatus that includes a housing and at least one spring disposed within the housing and around a mandrel slidably disposed in the housing. The apparatus also includes a first piston element disposed on one end of the mandrel and slidably disposed in the housing. Additionally, the apparatus includes an internal port radially disposed in the mandrel in fluid communication with a first annulus area disposed between the mandrel and the housing and in fluid communication with the first piston element. The apparatus further includes an external port radially disposed in the housing in fluid communication with a second annulus area disposed between a portion of the first piston element.

This disclosure is also directed towards a method of determining a vibrational frequency at which a vibratory tool useable in a downhole assembly operates, the downhole assembly separated into an upper bottom hole assembly and a lower bottom hole assembly having a mass and designing a vibration enhancing apparatus that cooperates with the lower bottom hole assembly to have a resonant frequency that is substantially equal to the vibrational frequency of the vibratory tool.

This disclosure is further directed toward a method of determining a resonant frequency of a vibration enhancing apparatus cooperating with a lower bottom hole assembly of a bottom hole assembly and designing a vibratory tool to be used in the bottom hole assembly having a vibrational frequency that is responsive to the resonant frequency of the vibration enhancing apparatus and the lower bottom hole assembly.

The disclosure is also directed toward a method of deploying a bottom hole assembly, the bottom hole assembly comprising a vibration enhancing apparatus and a vibratory tool; operating the vibratory tool at a vibrational frequency; and operating the vibration enhancing apparatus and a lower portion of the bottom hole assembly at a resonant frequency that is responsive to the predetermined frequency of the vibratory tool to maximize vibration amplitude of the bottom hole assembly.

DETAILED DESCRIPTION OF THE DISCLOSURE

Figure 1:
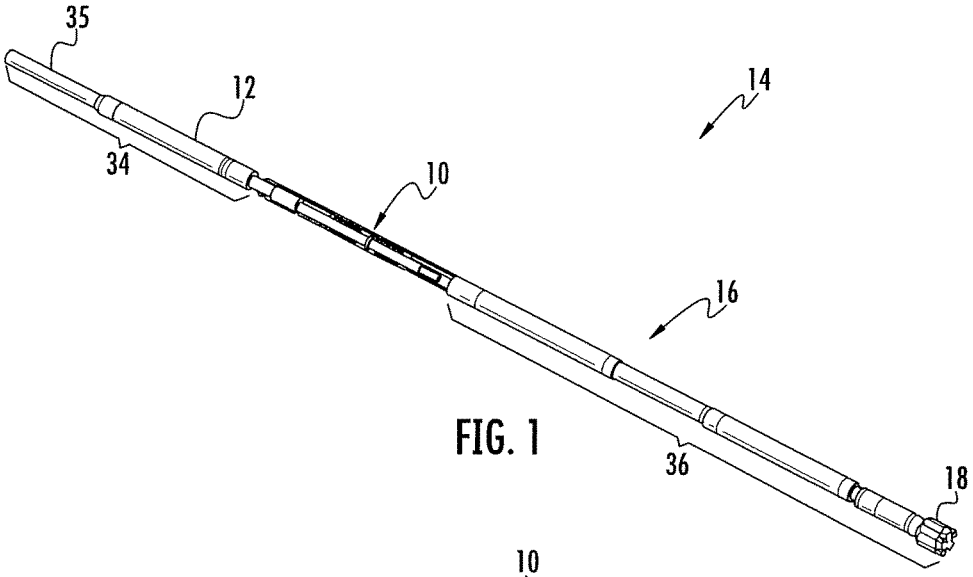
FIG. 1 is a perspective view of a bottom hole assembly constructed in accordance with the present disclosure.

The present disclosure relates to a vibration enhancing apparatus 10 that can be configured to be used with any type of vibratory tool 12 (or agitation tool) known in the art, such as the XRV produced by Thru Tubing Solutions, the NOV Agitator, or the Tempress produced by Oil States, to amplify the vibration or agitation provided by the vibratory tool 12. The present disclosure is also directed toward a method of using the apparatus 10 and a method of tuning the apparatus 10 to maximize the amplification of the vibratory tool 12. As shown in FIG. 1, the apparatus 10 described herein can be incorporated into a bottom hole assembly (BHA) 14 with a vibratory tool 12 and other types of downhole tools known in the art, such as, motors 16 and drill bits 18. The amplification of the vibration of the vibratory tool 12 provides additional vibration to the BHA 14 to assist in advancing the BHA 14 into the wellbore. The vibration enhancing apparatus 10 can be disposed above or below the vibratory tool 12 in the BHA 14.

Figure 2:
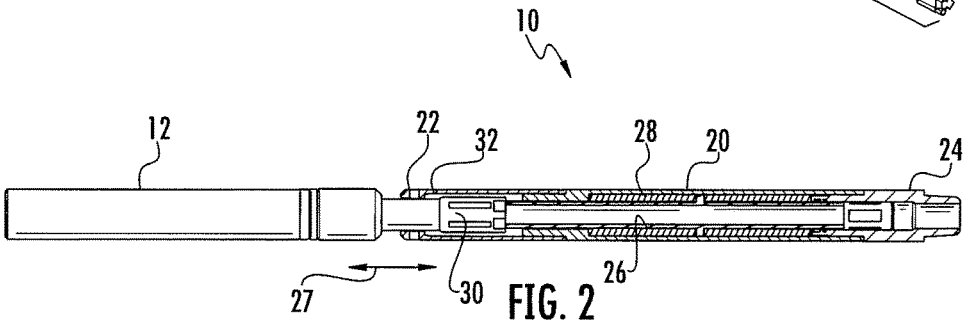
FIG. 2 is a partial side elevational view and a partial cross-sectional view of a downhole tool constructed in accordance with the present disclosure.
Figure 3:
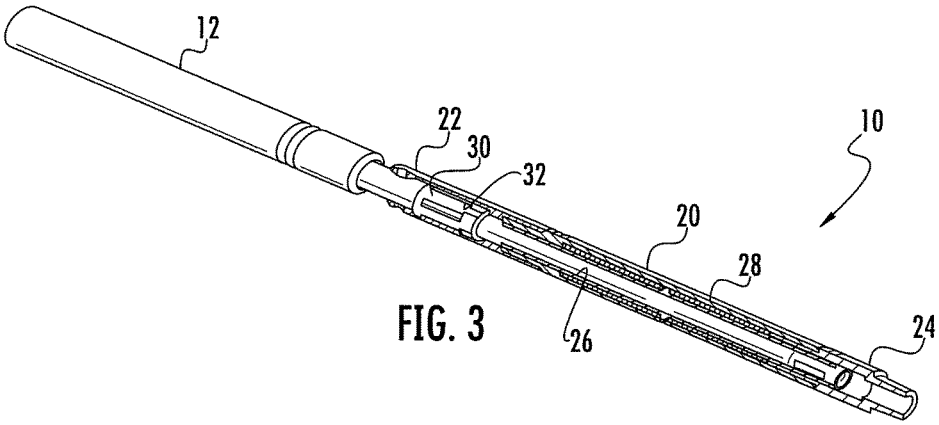
FIG. 3 is a perspective view of the downhole tool constructed in accordance with the present disclosure.

The apparatus 10, shown in more detail in FIGS. 2 and 3, includes a housing 20, a first end 22, a second end 24, a fluid passageway 26, and at least one spring 28 disposed within the housing 20. The at least one spring 28 can be a mechanical spring, oil-spring, gas-spring, and the like. In one embodiment, the at least one spring 28 can be disposed between the fluid passageway 26 and the housing 20. In another embodiment, the fluid passageway 26 can be disposed between a spring housing (not shown) and the housing 20, which could cause the fluid passageway 26 to be disposed around the at least one spring 28 or outside of the at least one spring 28. In this embodiment, the fluid passageway 26 could be an annulus area disposed between the at least one spring 28 and the housing 20.

In one embodiment, the apparatus 10 can be disposed downhole from the vibratory tool 12 in the BHA 14. In this embodiment, the first end 22 of the apparatus 10 is in fluid communication with the vibratory tool 12 and the fluid passageway 26. The second end 24 would be adapted to be connectable to other downhole tools to be disposed downhole of the apparatus 10. In another embodiment, the apparatus 10 can be disposed uphole from the vibratory tool 12 in the BHA 14. In this embodiment, the first end 22 of the apparatus 10 would be adapted to be connectable to other downhole tools to be disposed uphole of the apparatus 10. The second end 24 of the apparatus 10 is in fluid communication with the fluid passageway 26 and the vibratory tool 12 disposed below.

The end 22 or 24 in fluid communication with the vibratory tool 12 can extend from inside of the housing 20. This end 22 or 24 can also be provided with a splined section 30 disposed thereon to prevent the fluid passageway 26 and the at least one spring 28 from rotating independently of the housing 20, vibratory tool 12 or the BHA 14. The apparatus 10 further includes a spline receiving area 32 to cooperate with the splined section 30 to allow the housing 20, the end 22 or 24 opposite of the vibratory tool 12 and the tools disposed below the apparatus 10 to have axial motion represented by reference numeral 27 with respect to the vibratory tool 12, yet still prevent the fluid passageway 26 and the at least one spring 28 from rotating independently of the housing 20, vibratory tool 12 or the BHA 14.

As previously stated, this disclosure is also directed to a method of using the apparatus 10. The apparatus 10 and vibratory tool 12 are run into a wellbore. Fluid can then be pumped into and through the vibratory tool and the apparatus 10 to advance the BHA 14 further into the wellbore.

In another aspect of the present disclosure, a method of tuning or optimizing the effectiveness of the apparatus 10 is disclosed herein. Any tools in the BHA 14 disposed uphole (upper BHA 34 and tubing 35) from the apparatus 10 provides the driving force for the BHA 14 into the wellbore and all tools in the BHA 14 disposed below the apparatus 10 is considered the lower BHA 36. The at least one spring 28 in the apparatus 10 allows free axial movement between the upper BHA 34 and the lower BHA 36 while the splined section 30 and the spline receiving area 32 cooperate to restrict rotational motion between the upper BHA 34 and the lower BHA 36.

Figure 4:
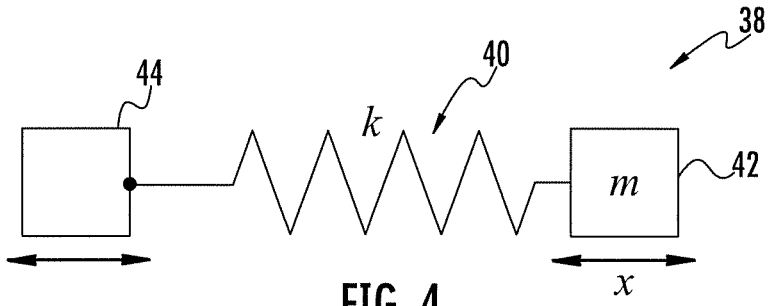
FIG. 4 is a diagrammatic view of a spring-mass system.

FIG. 4 shows a diagram depicting a typical spring-mass system 38. The spring-mass system 38 includes a spring 40, a mass 42 and a point 44 from which the spring 40 and mass 42 oscillate. The apparatus 10 represents the spring 40 in a typical spring-mass system 38. The lower BHA 36 represents the mass in the typical spring-mass system 38. The upper BHA 34 represents the point 44 from which the mass 42 (lower BHA 36) and the spring 40 (apparatus 10) oscillate. The typical spring-mass system 38 has a resonant frequency at which it oscillates, known as its natural frequency.

In one embodiment, the vibratory tool 12 used in the BHA 14 will have a unique vibrational frequency. The apparatus 10 can be set up to cooperate with the lower BHA 36 to have a resonant frequency that is equivalent to the unique vibrational frequency of the vibratory tool 12. The resonant frequency (f) is a function of the spring constant (K) and the mass (M) (i.e., the mass of the tools disposed below the apparatus 10 or the mass of the tools present in the lower BHA 36) present within the system, and can be determined using the following equation:

$$f = \frac{1}{2\pi}\sqrt{K/M}$$

The vibrational frequency of the vibratory tool 12 used in the BHA 14 can be calculated or measured. Once the vibrational frequency of the vibratory tool 12 has been determined, the following equation can be used to determine the spring constant (K) which will cause the natural frequency of the spring mass system represented by the apparatus 10 and the lower BHA 36 to match the input frequency of the vibratory tool 12:

$$K=M(2\pi f)^2$$

The at least one spring 28 of the apparatus 10 can be designed such that it has the required spring constant (K) to maximize the vibration amplitude of the BHA 14 from the vibratory tool 12 and the apparatus 10. In one embodiment, the at least one spring 28 and/or the mass of the lower BHA 36 can be adjusted to achieve the maximum vibration amplitude of the BHA 14.

In another embodiment, the vibratory tool 12 can be designed to have a specific frequency to match the resonant frequency of a specific apparatus 10 having a predetermined spring constant (K) and the mass of a specific lower BHA 36.

In yet another aspect of the present disclosure, a method for designing the apparatus 10, adjusting the mass of the lower BHA 36 and/or designing the vibratory tool 12 to make the unique frequency of the vibratory tool substantially equal to the resonant frequency of the apparatus 10 and the lower BHA 36 is disclosed. In one aspect of this embodiment, the unique vibrational frequency of the vibratory tool 12 is determined. The vibrational frequency of the vibratory tool 12 is used to design the at least one spring 28 of the apparatus 10 to maximize the vibration amplitude of the BHA 14. The method can also include the step manipulating the mass of the lower BHA 36 and/or the at least one spring 28 to have a resonant frequency that matches the frequency of the vibratory tool 12 to maximize the vibration amplitude of the BHA 14. In another embodiment, the resonant frequency of the apparatus 10 and the lower BHA 36 is determined. Once the resonant frequency of the apparatus 10 and the lower BHA 36 is determined, the vibratory tool 12 can be designed to have a vibrational frequency substantially equal to the resonant frequency of the apparatus 10 and the lower BHA 36.

The apparatus 10 can be designed with a "pump-open" or "pump-closed" area. When the apparatus 10 is of the "pump-open" type, a method is provided wherein the apparatus 10 is caused to extend the apparatus 10 when the pressure of the fluid flowing through the apparatus 10 is greater than the pressure of the fluid outside of the apparatus 10, and contract the apparatus 10 when the pressure of the fluid is greater outside of the apparatus 10 than the pressure of the fluid is inside the apparatus 10. Conversely, when the apparatus 10 is of the "pump-closed" type, a method is provided wherein the apparatus 10 is caused to contract the apparatus 10 when the pressure of the fluid flowing through the apparatus 10 is greater than the pressure of the fluid outside of the apparatus 10, and extend the apparatus 10 when the pressure of the fluid is greater outside of the apparatus 10 than the pressure of the fluid is inside the apparatus 10.

When the vibratory tool 12 operates, there is fluid pulsation through the apparatus 10 which occurs at the same frequency as the vibratory force generated by the vibratory tool 12. This fluid pulsation causes pressure fluctuations above and below the vibratory tool 12. If the apparatus 10 is designed with a pump-open or pump-closed area and is positioned such that it is exposed to the fluid pressure fluctuations produced by the vibratory tool 12, a hydraulic force will be generated within the apparatus 10 which will cause the apparatus 10 to experience a cyclic contraction/extension force. If the spring 28/mass of the BHA 14 is "tuned" to this cyclic loading frequency, maximum vibration of the BHA 14 and tubing will result. So, another novel concept is to "tune" the natural frequency of the BHA 14 to match the cyclic hydraulic loading produced by the vibratory tool 12 acting on a spring tool with a "pump-open/closed" area.

Figure 5:
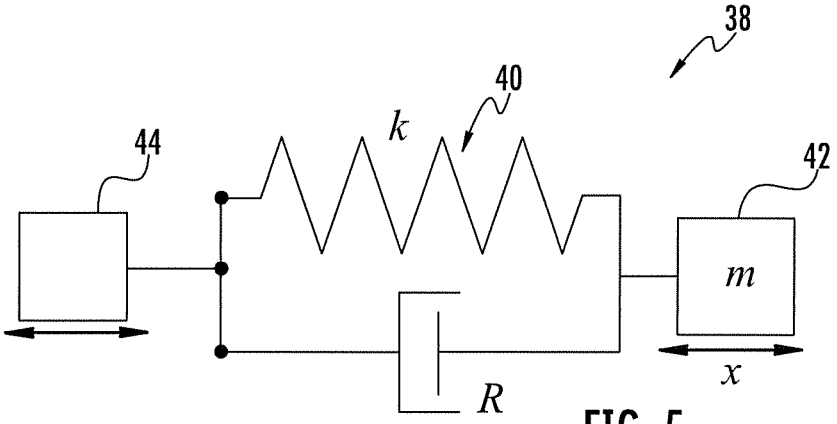
FIG. 5 is a diagrammatic view of another embodiment of the spring-mass system.

In real systems, there is often significant damping in addition to the spring and mass. FIG. 5 depicts this real system where damping can be incorporated into the spring-mass system. There is a "damped" natural frequency which is different than the undamped natural frequency. Similar calculations can be used to calculate the damped natural frequency as the undamped frequency described previously. All methods, etc., described for the undamped system can be equally applied to the damped system. The following equations are used to evaluate the damped natural frequency:

$\alpha = R/(2m)$ is a decay constant and $\omega_d = \sqrt{\omega_0^2 - \alpha^2}$ is the characteristic (or natural) angular frequency of the system.

Figure 6:
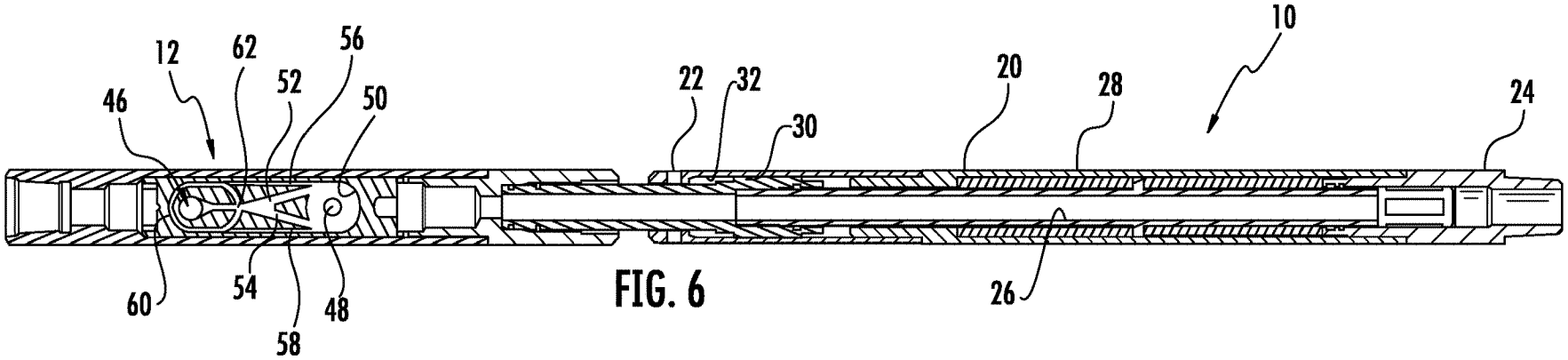
FIG. 6 is a cross-sectional view of one embodiment of the downhole tool constructed in accordance with the present disclosure.
Figure 7:
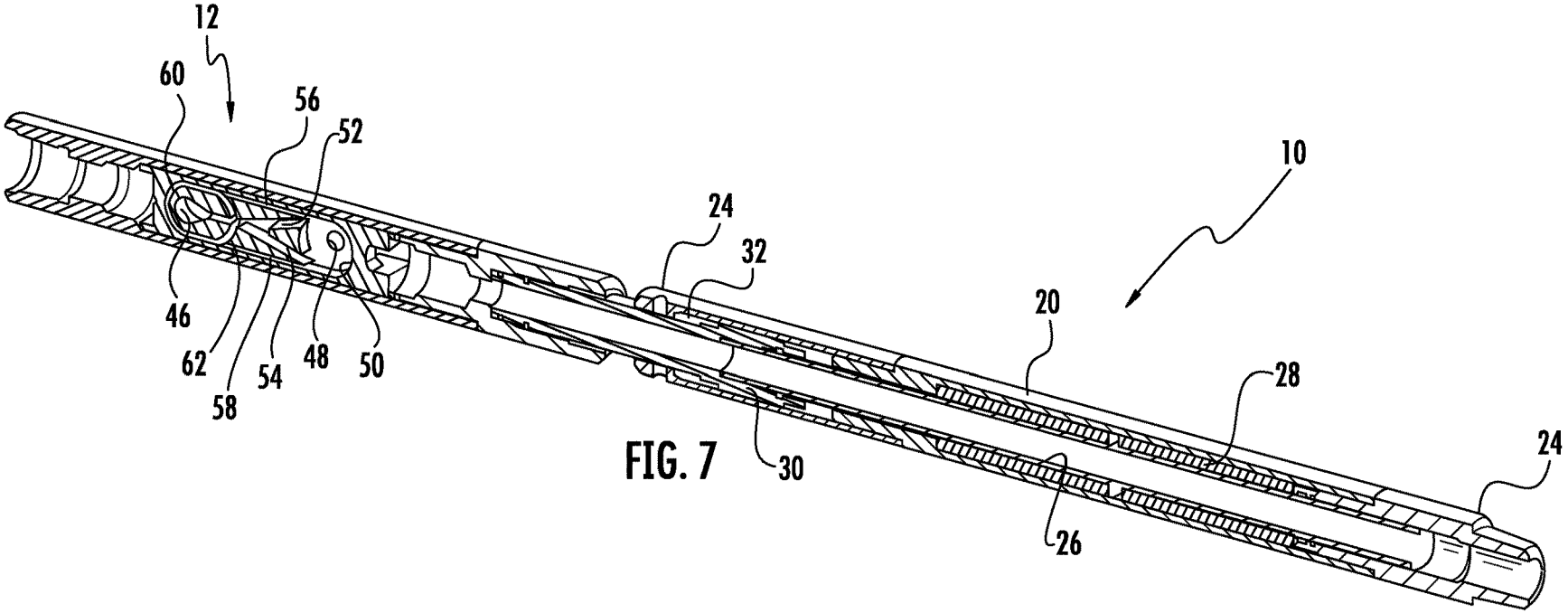
FIG. 7 is a perspective, cross-sectional view of the embodiment of the downhole tool shown in FIG. 6 constructed in accordance with the present disclosure.

FIGS. 6 and 7 depict a specific embodiment of the present disclosure wherein the vibration enhancing apparatus 10 is used with a vibratory tool 12 having an inlet 46, an outlet 48 and a vortex chamber 50. In addition, the vibratory tool 12 in this embodiment can include a first fluid port 52 and a second fluid port 54, which are both in fluid communication with the inlet 46 and the vortex chamber 50. Furthermore, the vibratory tool 12 in this embodiment can include a first fluid return port 56 and a second fluid return port 58. The first and second fluid return ports 56 and 58 allow for a portion of the fluid entering the vortex chamber 50 to be returned to a fluid loop port 60. The fluid loop port 60 directs fluid from the first and second fluid return ports 56 and 58 to an interchange area 62 where the fluid flowing in from the inlet 46 is directed back and forth from the first fluid port 52 to the second fluid port 54.

Figure 8:
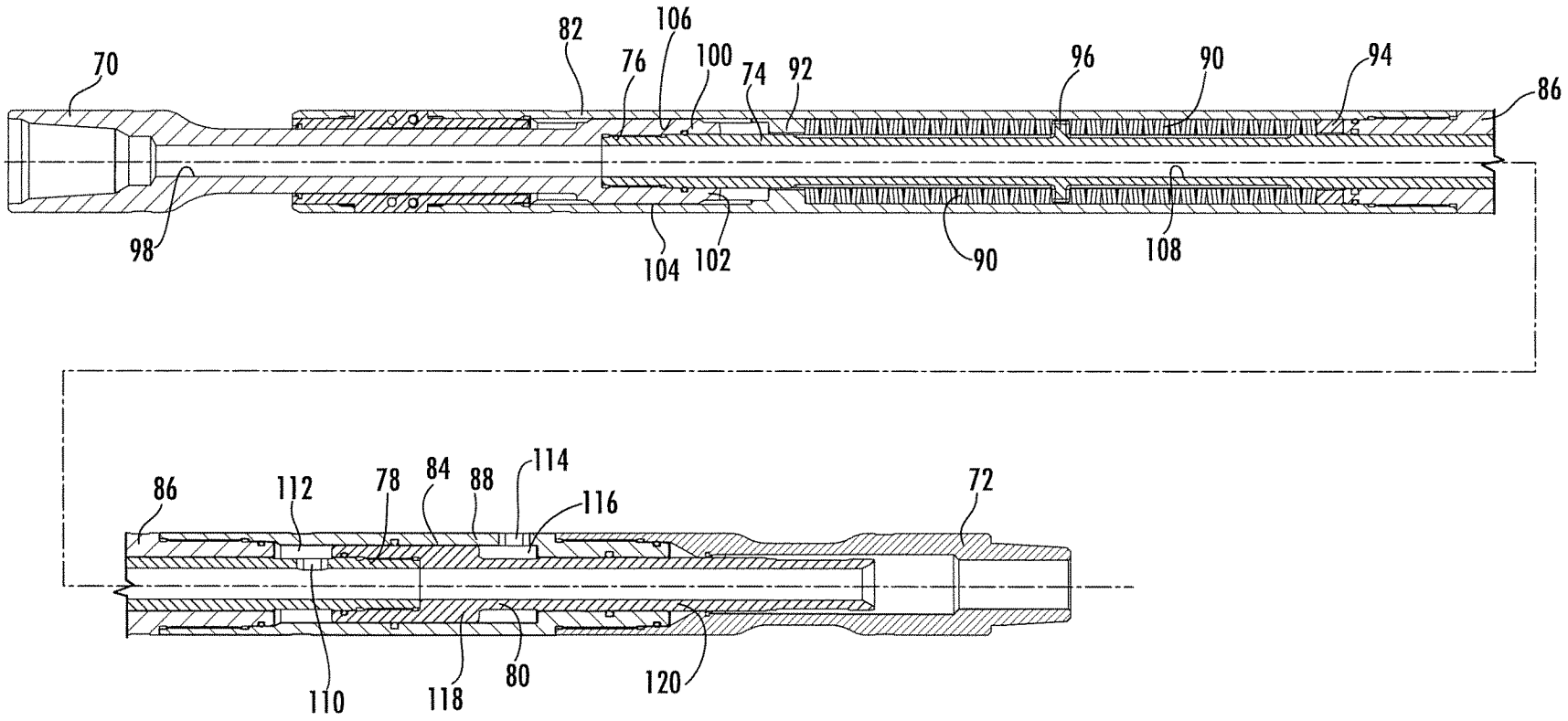
FIG. 8 is a cross-sectional view of another embodiment of the downhole tool constructed in accordance with the present disclosure.

In another embodiment of the present disclosure, FIG. 8 shows the apparatus 10 in a "pump-closed" embodiment. The apparatus 10 includes a top sub 70 for connection to other downhole tools disposed above the apparatus 10 in the BHA 14 and a bottom sub 72 for connection to other downhole tools disposed below the apparatus 10 in the BHA 14. The apparatus 10 further includes a mandrel 74 supported by or connected to the top sub 70 on an upper end 76 of the mandrel 74. The other end of the mandrel 74, or lower end 78, is supported by or connected to a piston element 80.

The apparatus 10 of the embodiment shown in FIG. 8 further includes an upper housing 82, a lower housing 84 and a connector element 86 disposed between the upper housing 82 and the lower housing 84. The connector element 86 can be threaded on each end to attach to the upper housing 82 and the lower housing 84. A lower end 88 of the lower housing 84 is connected to the bottom sub 72. A portion of top sub 70, the mandrel 74, and the piston element 80 are slidably disposed within and move independently of the upper housing 82, the lower housing 84, the connector element 86 and the bottom sub 72.

The apparatus 10 includes at least one spring 90 disposed around the mandrel 74 and between the mandrel 74 and the upper housing 82. In one embodiment, the spring 90 is disposed between an upper shoulder 92 disposed on the inside of the upper housing 82 and a lower shoulder 94 disposed on the inside of the upper housing 82. In another embodiment, the apparatus 10 includes two springs 90 where the springs are separated by a lip element 96 disposed on the inside of the upper housing 82. It should be understood and appreciated that the lip element 96 is disposed on the inside of the upper housing 82 between the upper shoulder 92 and the lower shoulder 94. Furthermore, the apparatus 10 can be designed to incorporate any desired number of springs 90.

The top sub 70 has a passageway 98 disposed therein to permit fluid to flow through the top sub 70 and into the mandrel 74. The top sub 70 includes a splined section 100 on a lower end 102 of the top sub 70 where splines 104 extend radially therefrom. The splines 104 engage a spline receiving area 106 disposed on the inside of the upper housing 82. The splines 104 engagement with the spline receiving area 106 prevent the top sub 70, and thus the mandrel 74 and the piston element 80, from rotating independently of the upper housing 82, the lower housing 84, the connector element 86 and the bottom sub 72.

The mandrel 74 includes a passageway 108 axially disposed therein to permit fluid to flow from the top sub 70 and through the mandrel 74. The mandrel 74 also includes an internal port 110 radially disposed in the lower end 78 of the mandrel 74 to permit fluid to flow into an annulus area 112 and engage with a portion of the piston element 80. The annulus area 112 is disposed between the connector element 86 and the piston element 80 that is attached to the lower end 78 of the mandrel 74. As fluid, which is at a higher pressure than fluid outside of the apparatus 10, flows into the annulus area 112, the bottom sub 72, the lower housing 84 and the upper housing 82 are forced to move in the uphole direction with respect to the top sub 70, the mandrel 74 and the piston element 80. This uphole movement of the bottom sub 72, the lower housing 84 and the upper housing 82 causes the apparatus 10 to contract and compress the spring(s) 90.

Further, the lower housing 84 includes an external port 114 in fluid communication with a second annulus area 116 disposed between the piston element 80 and the lower housing 84. The second annulus area 116 is disposed on the downhole side of a piston head 118 of the piston element 80. When the pressure of the fluid outside of the apparatus 10 becomes higher than the pressure of the fluid flowing through the apparatus 10, the bottom sub 72, the lower housing 84 and the upper housing 82 are forced to move in the downhole direction with respect to the top sub 70, the mandrel 74 and the piston element 80. This downhole movement of the bottom sub 72, the lower housing 84 and the upper housing 82 causes the apparatus 10 to extract and thus, reduce the compression of the spring(s) 90. In this embodiment, the piston element 80 can further include a tubular extension 120 that extends into the lower sub 72 and is slidably disposed therein.

Figure 9:
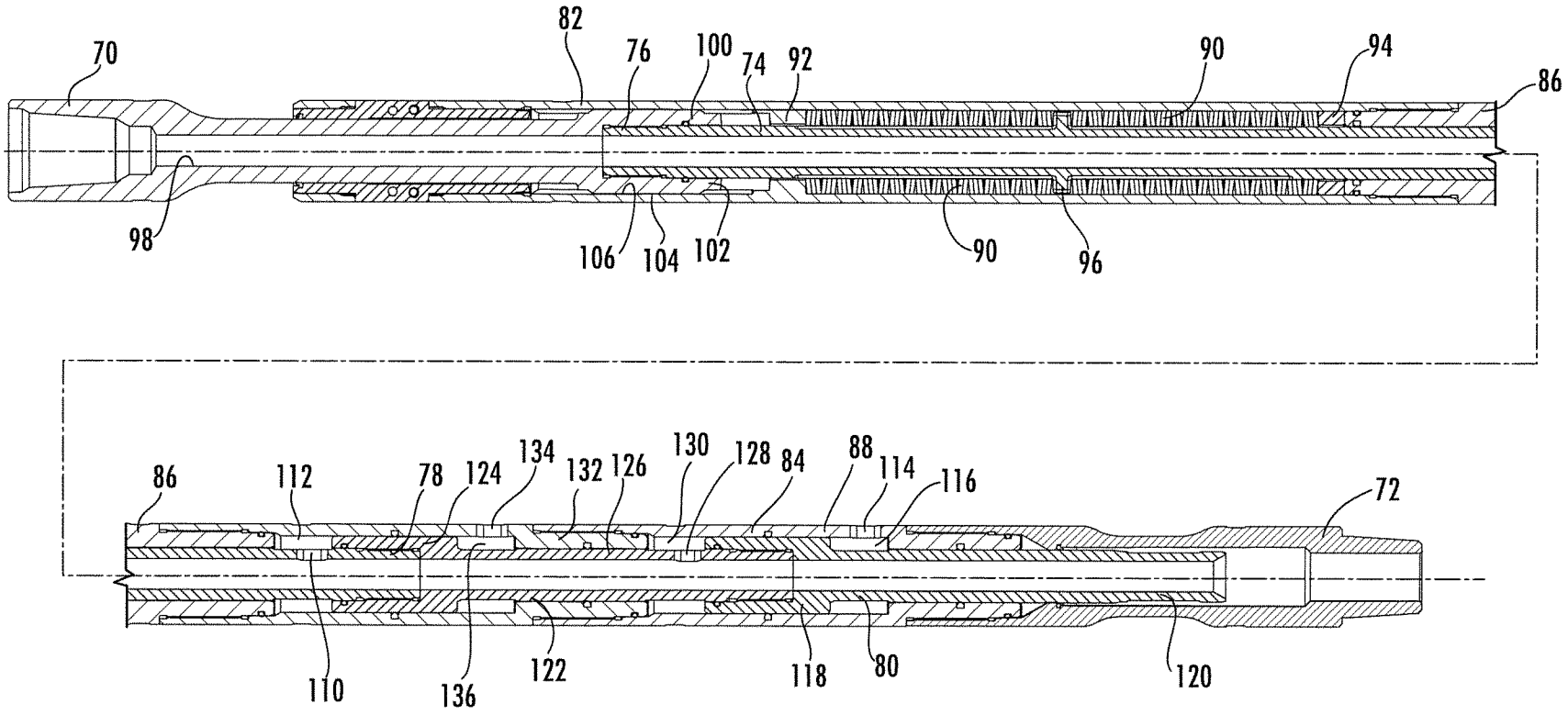
FIG. 9 is a cross-sectional view of yet another embodiment of the downhole tool constructed in accordance with the present disclosure.

In a further embodiment of the present disclosure shown in FIG. 9, the apparatus 10 can include a second piston element 122 disposed between the piston element 80 and the mandrel 74. The second piston element 122 includes a piston head 124 and a tubular extension 126 extending therefrom. The piston head 124 of the second piston element 122 is connected to the lower end 78 of the mandrel 74 and the tubular extension 126 of the second piston element 122 is connected to the piston head 118 If the piston element 80. The lower end of the tubular extension 126 of the piston element 122 further includes an internal port 128 radially disposed therein in fluid communication with a third annulus area 130 and the piston head 118 of the piston element 80. The piston elements 80 and 122 both have passageways disposed therein to permit fluid to flow from the mandrel 74 into and out of the lower sub 72.

Similar to the operation of the apparatus 10 previously described herein, the second piston element 122 increases the contraction of the apparatus 10 and the compression of the spring 90. The third annulus area 130 is disposed between a shoulder section 132 disposed on the inside of the lower housing 84 and the piston element 80 that is attached to the lower end of the second piston element 122. As fluid, which is at a higher pressure than fluid outside of the apparatus 10, flows into the third annulus area 130, the bottom sub 72, the lower housing 84 and the upper housing 82 are forced to move in the uphole direction with respect to the top sub 70, the mandrel 74, the piston element 80, and the second piston element 122. This uphole movement of the bottom sub 72, the lower housing 84 and the upper housing 82 causes the apparatus 10 to contract and compress the spring(s) 90.

Further, the lower housing 84 includes a second external port 134 in fluid communication with a fourth annulus area 136 disposed between the piston element 80 and the lower housing 84. The fourth annulus area 136 is disposed on the downhole side of the piston head 124 of the piston element 122 and uphole of the shoulder section 132 of the lower housing 84. When the pressure of the fluid outside of the apparatus 10 becomes higher than the pressure of the fluid flowing through the apparatus 10, the bottom sub 72, the lower housing 84 and the upper housing 82 are forced to move in the downhole direction with respect to the top sub 70, the mandrel 74, the piston element 80, and the second piston element 122. This downhole movement of the bottom sub 72, the lower housing 84 and the upper housing 82 causes the apparatus 10 to extract and thus, reduce the compression of the spring(s) 90. While only two piston elements 80 and 122 are shown in FIG. 9, it should be understood and appreciated that any number of piston elements can be included and the corresponding internal and external ports as desirable by an operator of the apparatus 10.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. A vibration enhancing apparatus, the apparatus comprising:

a first end;

a second end;

a passageway disposed at least partially within a housing to permit fluid to flow through the vibration enhancing apparatus; and at least one spring having a spring constant that is responsive to a vibratory tool and other tools used in a bottom hole assembly with the vibration enhancing apparatus to enhance and increase the vibration induced on the bottom hole assembly by the vibratory tool wherein the vibration induced on the bottom hole assembly by the vibration enhancing apparatus is greater than the vibration induced on the bottom hole assembly by the vibratory tool alone, the at least one spring causing the vibration enhancing apparatus to have a resonant frequency that is substantially equal to a vibrational frequency at which the vibratory tool operates.

2. The apparatus of claim 1 wherein the passageway is disposed substantially through the center of the apparatus and the at least one spring is disposed outside of the passageway.

3. The apparatus of claim 1 wherein the passageway extends past the first end of the apparatus to be connectable with the vibratory tool.

4. The apparatus of claim 1 wherein the apparatus includes a spline receiving area and the passageway has a splined section disposed on an outside portion thereof, the spline receiving area and the splined section cooperate to prevent the apparatus to rotate relative to the vibratory tool yet still permit axial motion of the apparatus relative to the vibratory tool.

5. The apparatus of claim 1 wherein the apparatus expands when pressure of the fluid pumped through the apparatus is greater than the pressure of the fluid outside of the apparatus.

6. A vibration enhancing apparatus, the apparatus comprising:

a housing;

a bottom sub disposed adjacent to the housing;

at least one spring disposed within the housing and around a mandrel slidably disposed in the housing, the entire mandrel slidably disposed within the housing and the bottom sub;

a first piston element disposed on one end of the mandrel and slidably disposed in the housing;

a second piston element disposed on another part of the mandrel and slidably disposed within the housing;

a first internal port radially disposed in the mandrel in fluid communication with a first annulus area disposed between the mandrel and the housing and in fluid communication with the first piston element;

a first external port radially disposed in the housing in fluid communication with a second annulus area, the first external port disposed between a portion of the first piston element and a lower housing, the second annulus area disposed radially between a portion of the mandrel and a portion of the housing;

a second internal port radially disposed in the mandrel in fluid communication with a third annulus area disposed between the mandrel and the housing and in fluid communication with the second piston element;

a second external port radially disposed in the housing in fluid communication with a fourth annulus area, the second external port disposed between a portion of the second piston element and the lower housing, the fourth annulus area disposed radially between a portion of the mandrel and a portion of the housing; and wherein the first and second internal ports are disposed uphole of the first and second external ports, respectively.

7. The apparatus of claim 6 further comprising a top sub connected to the mandrel for connecting the apparatus to other tools disposed above the apparatus in a bottom hole assembly, the top sub including a splined section having splines extending therefrom to engage a spline receiving area on the inside of the housing to prevent the top sub, mandrel and the first piston from rotating independently from the housing.

8. The apparatus of claim 6 wherein the housing is comprised of an upper housing, a lower housing and a connector element disposed between the upper housing and the lower housing.

9. The apparatus of claim 6 wherein the apparatus contracts when pressure of the fluid pumped through the apparatus is greater than the pressure of the fluid outside of the apparatus.

10. A method, the method comprising:

determining a vibrational frequency at which a vibratory tool in a downhole assembly operates, the downhole assembly separated into an upper bottom hole assembly and a lower bottom hole assembly; and constructing a vibration enhancing apparatus having a resonant frequency that is substantially equal to the vibrational frequency of the vibratory tool to increase the vibration induced on the downhole assembly wherein the vibration induced on the downhole assembly by the vibration enhancing apparatus is greater than the vibration induced on the downhole assembly by the vibratory tool alone, the lower bottom hole assembly having a mass and includes any tools disposed below the vibration enhancing apparatus.

11. The method of claim 10 wherein the vibration enhancing apparatus includes at least one spring having a spring constant, the at least one spring compressable responsive to the mass of the lower bottom hole assembly.

12. The method of claim 11 further comprising the step of determining the spring constant for the at least one spring in the vibration enhancing apparatus responsive to the mass of the lower bottom hole assembly and the vibrational frequency of the vibratory tool.

13. The method of claim 11 further comprising the step of designing the at least one spring to have a spring constant that is responsive to the mass of the lower bottom hole assembly and the vibrational frequency of the vibratory tool.

14. The method of claim 13 wherein the spring constant of the at least one spring cooperates with the mass of the lower bottom hole assembly so that the vibration enhancing apparatus and the lower bottom hole assembly cooperate to have a resonant frequency that is substantially equal to the vibrational frequency of the vibratory tool.

15. The method of claim 11 further comprising the steps of determining the spring constant for the at least one spring in the vibration enhancing apparatus and adjusting the mass of the lower bottom hole assembly to cooperate with the at least one spring to generate a resonant frequency that is substantially equal to the vibrational frequency of the vibratory tool.

16. The method of claim 11 wherein the vibration enhancing apparatus further includes a first end, a second end, and a passageway disposed at least partially within a housing to permit fluid to flow through the vibration enhancing apparatus.

17. The method of claim 10 wherein the upper bottom hole assembly includes the vibratory tool and any other downhole tools disposed above the vibration enhancing apparatus and the lower bottom hole assembly includes any other downhole tool disposed below the vibration enhancing apparatus.

18. A method, the method comprising:

determining a resonant frequency of a vibration enhancing apparatus disposed in a bottom hole assembly, the bottom hole assembly including a lower bottom hole assembly having a mass and an upper bottom hole assembly, the mass of the lower bottom hole assembly and the vibration enhancing apparatus cooperating to generate the resonant frequency, the lower bottom hole assembly includes any downhole tools disposed below the vibration enhancing apparatus; and constructing a vibratory tool to be used in the bottom hole assembly having a vibrational frequency that is responsive to the resonant frequency of the vibration enhancing apparatus and the lower bottom hole assembly so that the vibration enhancing apparatus increases the vibration induced on the bottom hole assembly applied to the bottom hole assembly by the vibratory tool wherein the vibration induced on the bottom hole assembly by the vibration enhancing apparatus is greater than the vibration induced on the bottom hole assembly by the vibratory tool alone.

19. The method of claim 18 wherein the resonant frequency of the vibration enhancing apparatus and the mass of the lower bottom hole assembly is responsive to a spring constant of at least one spring disposed in the vibration enhancing apparatus.

20. The method of claim 18 wherein the upper bottom hole assembly includes the vibratory tool and any other downhole tools disposed above the vibration enhancing apparatus.

21. The method of claim 19 wherein the vibration enhancing apparatus further includes a first end, a second end, and a passageway disposed at least partially within a housing to permit fluid to flow through the vibration enhancing apparatus.

22. The method of claim 18 wherein the vibrational frequency of the vibratory tool is substantially equal to the resonant frequency of the vibration enhancing apparatus and the lower bottom hole assembly.

23. A method, the method comprising:

deploying a bottom hole assembly, the bottom hole assembly comprising a vibration enhancing apparatus and a vibratory tool;

operating the vibratory tool at a vibrational frequency; and operating the vibration enhancing apparatus and a lower portion of the bottom hole assembly at a resonant frequency that is responsive to the predetermined frequency of the vibratory tool to maximize and increase vibration induced on the bottom hole assembly wherein the vibration induced on the bottom hole assembly by the vibration enhancing apparatus is greater than the vibration induced on the bottom hole assembly by the vibratory tool alone.

24. The method of claim 23 wherein the vibratory tool is operated at a vibrational frequency that is responsive to the resonant frequency of the vibration enhancing apparatus and the lower portion of the bottom hole assembly.

25. The method of claim 23 wherein the vibration enhancing apparatus includes at least one spring having a spring constant.

26. The method of claim 25 wherein the spring constant of the at least one spring cooperates with a mass associated with the lower bottom hole assembly so that the vibration enhancing apparatus and the lower bottom hole assembly cooperate to have a resonant frequency that is substantially equal to the vibrational frequency of the vibratory tool.

27. The method of claim 25 wherein the vibration enhancing apparatus further includes a first end, a second end, and a passageway disposed at least partially within a housing to permit fluid to flow through the vibration enhancing apparatus.

28. The method of claim 23 wherein the upper bottom hole assembly includes the vibratory tool and any other downhole tools disposed above the vibration enhancing apparatus and the lower bottom hole assembly includes any other downhole tool disposed below the vibration enhancing apparatus.

* * * * *